US007293664B2

(12) United States Patent
Belokin et al.

(10) Patent No.: US 7,293,664 B2
(45) Date of Patent: Nov. 13, 2007

(54) SUSPENDED DISPLAY SHELVES

(75) Inventors: Paul Belokin, Denton County, TX (US); Martin P. Belokin, Denton County, TX (US); Norman P. Belokin, Denton County, TX (US)

(73) Assignee: Displays by Martin Paul, Inc. - Creative Center, Denton, TX (US)

( * ) Notice: Subject to any disclaimer, the term of this patent is extended or adjusted under 35 U.S.C. 154(b) by 175 days.

(21) Appl. No.: 11/198,638

(22) Filed: Aug. 8, 2005

(65) Prior Publication Data

US 2007/0029271 A1 Feb. 8, 2007

(51) Int. Cl.
*A47F 5/08* (2006.01)

(52) U.S. Cl. ..... 211/113; 211/117

(58) Field of Classification Search ..... 211/90.01, 211/117, 118, 113, 88.01, 126.16, 85, 126.1, 211/85.29, 85.26; 108/59, 92, 147.11, 106, 108/182, 149; 248/317, 320, 323, 339
See application file for complete search history.

(56) References Cited

U.S. PATENT DOCUMENTS 889,517 A * 6/1908 Gerken ..... 108/23
2,556,105 A * 6/1951 Rhett ..... 108/106
4,061,092 A * 12/1977 Jacobsen et al. ..... 108/149
4,108,084 A * 8/1978 Fink ..... 108/29
4,317,522 A * 3/1982 Garrett ..... 211/113
4,388,982 A * 6/1983 Yonahara ..... 182/82
5,111,943 A * 5/1992 Ramey ..... 211/59.4
5,749,479 A * 5/1998 Belokin et al. ..... 211/113
5,779,068 A * 7/1998 Whiten et al. ..... 211/117
5,947,302 A * 9/1999 Miller ..... 211/49.1
6,116,164 A * 9/2000 Justen, Jr. ..... 108/42
6,595,145 B1 * 7/2003 Lietz ..... 108/149
6,814,418 B2 * 11/2004 D'Orso ..... 312/351
6,951,291 B2 * 10/2005 Kleanthis ..... 211/163
7,097,053 B1 * 8/2006 Karl et al. ..... 211/186
2005/0072748 A1 * 4/2005 Shai ..... 211/87.01
2006/0213850 A1 * 9/2006 VanCalbergh et al. ... 211/94.01

* cited by examiner

*Primary Examiner*—Jennifer E. Novosad
(74) *Attorney, Agent, or Firm*—Jack A. Kanz

(57) ABSTRACT

Shelves or trays for displaying merchandise are mounted on spaced-apart suspension strands depending from overhead ceiling structures. The trays are attached to the suspension strands with brackets which have tabs supported in apertures in the suspension strands and mechanical attachments which secure the tray to the bracket. The mechanical attachments are adjustable to accommodate orientation of the tray to permit gravity flow of merchandise forward or rearward in the tray. Promotional graphic displays may also be supported on the suspension strands.

15 Claims, 4 Drawing Sheets

SUSPENDED DISPLAY SHELVES

This invention relates to methods and apparatus for holding and displaying merchandise. More particularly, it relates to assemblies suspended from overhead structure of a retail store or the like and used to display merchandise, thereby utilizing formerly unused space and providing ready customer access to the displayed goods.

Various constructions of display arrangements such as multi-faceted display stands provided with one or more shelves, bins, receptacles or the like for the goods to be displayed are widely used. Display stands of this type are intended for use in store aisles and at similar locations where potential customers may approach the display stand from different directions or move about the stand to examine the goods on display.

Convenience stores have highly refined the art of displaying the maximum amount of goods in the minimum amount of floor space. Such stores typically have several aisles of open shelf displays, a number of refrigerated sections behind glass doors and counter space for hot and cold drink dispensers and unpackaged goods such as doughnuts and the like. The open shelf displays, however, are rarely over five feet in height and the space above counters is usually vacant. Thus, there remain substantially large amounts of space above the shelves in such stores which are not used for display of goods or advertising because display assemblies for holding and displaying goods or advertising displays in the open space above counters, above display shelves and elsewhere have not heretofore been available. Convenience stores generally do not have floor space to spare for the typical floor-mounted display stands used by larger supermarkets, hardware stores and the like, but often have large amounts of open space above and between aisles of fixed display shelves which are unused or underutilized.

Convenience stores typically have overhead structures comprising drop-style suspended ceilings which use a grid of supports spanning the ceiling space. Such drop-style suspended ceilings include a plurality of parallel supports suspended from the interior superstructure of the building. The supports are generally in the shape of an inverted T having horizontal portions supported by a vertical portion. Ceiling tiles are supported on the grid. Spacing of grid supports is standardized and, along with a variety of creative brackets designed to hold heavy merchandise and to be securely attached to hung ceiling supports, provide adequate support for the suspended displays contemplated herein. Appropriate attachment systems which depend from such overhead structure for supporting the suspended displays contemplated by this invention are available. Various such attachment systems are disclosed in United States Letters Patent No. 5,749,479 to Belokin, et al. which is incorporated herein by reference.

Many prior suspended displays for merchandise have been found unsatisfactory for a variety of reasons. Most lack either adequate support and/or stability. Some are difficult to assemble and use and some are simply too expensive to be of practical use. A need thus exists for apparatus which promotes display of merchandise in the space above floor stands, counter tops, fixed display shelves and in other open spaces which overcomes the deficiencies of prior devices. The displays must provide product presentation at a position convenient for customer access and, preferably, act in a manner to attract the attention of the customer. However, the display assembly must be easy to assemble and use and must be inexpensive and reliable. The displays must also be adaptable to display various types of merchandise without major modification of the display apparatus and should provide easily removeable and changeable advertising graphics and the like for promotion of the merchandise displayed.

In accordance with the present invention display apparatus is provided which includes a pair of spaced-apart suspension strands suspended from overhead structure and supporting a tray or shelf assembly therebetween. The suspension strands are preferably link chain or the like made of suitable lightweight material such as plastic. Each tray is supported between the suspension strands by a pair of brackets. One bracket is positioned on each side of the tray and adapted to be attached between the suspension strand and a side wall of the tray. Each tray has a floor and opposing sidewalls with attachment means for securing the sidewall to the bracket. The attachment means is preferably adjustable to permit suspension of the tray with the floor thereof substantially level or tilted (either back-to-front or front-to-back). Advertising graphics and the like may be displayed on the display apparatus by suspending a graphics display panel between the suspension strands above the display trays. By suspending the display apparatus from overhead structure, the display apparatus of the invention may be conveniently positioned to take advantage of otherwise unused space and present merchandise in a convenient position for customer access. The novel display apparatus thus supports and presents merchandise products at convenient customer access positions in a place of business. The suspended display apparatus takes advantage of space above counter tops, etc., which is otherwise unused and, since it is suspended, permits movement to attract customers. The apparatus of the invention is formed of simple, inexpensive mass-produced parts which can be easily and readily assembled into useable display assemblies and multiple units may be attached together to form larger displays.

Other features and advantages of the invention will become more readily understood from the following detailed description taken in connection with the appended claims and attached drawing in which:

Figure 1:
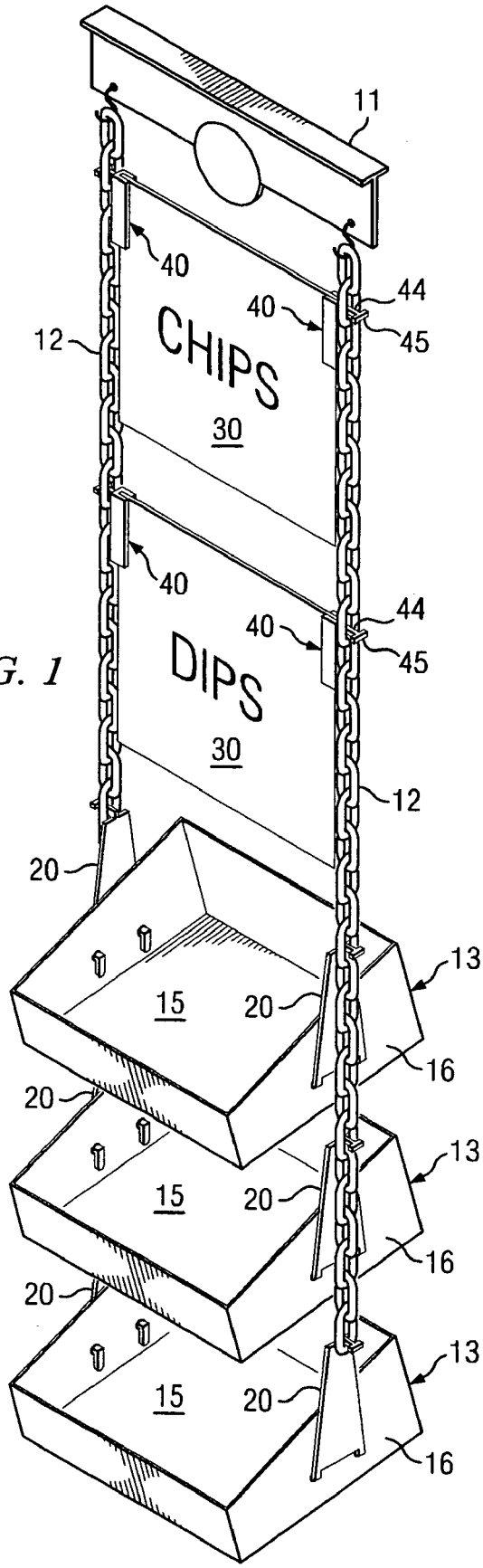
FIG. 1 is a schematic representation of a preferred embodiment of apparatus for supporting and displaying merchandise in accordance with the invention.

The drawing is incorporated into and forms part of the specification to illustrate exemplary embodiments of the invention. For clarity of illustration, like reference numerals designate corresponding elements throughout the drawing. It will be recognized that the principles of the invention may be utilized and embodied in many and various forms. In order to demonstrate these principles, the invention is described herein by reference to specific preferred embodiments. The invention, however, is not limited to the specific forms illustrated and described in detail.

While the invention is described and illustrated herein as apparatus for supporting and displaying merchandise, the term "merchandise" is intended to be given its broadest possible meaning and may include anything from food products to hardware, packaged or unpackaged. Accordingly, the terms "tray" and "shelf" are used interchangeably to mean any receptacle with a floor (which may be solid, perforated, screen or net) on or through which merchandise may be supported or suspended.

A preferred embodiment of the invention is illustrated in FIG. 1. The entire assembly is supported from overhead structure by a suitable suspension means 11 adapted for attachment to overhead structure such as illustrated in United States Letters Patent No. 5,749,479. The suspension means may be of any desired shape or design, it only being necessary that the suspension means 11 is attachable to overhead structure and provides means from which the suspension strands of the invention may be suspended.

In the embodiment of FIG. 1 a pair of suspension strands 12 (illustrated as link chain) depend from suspension means 11. As illustrated in FIG. 1, three (3) shelves or trays 13 are suspended in a stacked arrangement between parallel suspension strands 12 and two (2) graphic display panels are suspended above the trays 13. Obviously, the number of trays and/or display panels may vary as desired.

Although the trays 13 may be of any desired shape or size, depending on their intended use, the trays 13 illustrated have a floor 15 and opposing side walls 16. Each tray 13 also has a front wall 17 of a first height and a back wall 18 of a second height. The front wall 17 and back wall 18 may, of course, be of the same height if desired. It will also be recognized that the floor 15, as well as any of the walls, need not be solid as illustrated but may be perforated, screen structures or the like, depending on intended use and desired aesthetics.

The trays 13 are supported by brackets 20 which are attached between side walls 16 and suspension strands 12.

In the embodiment illustrated suspension strands 12 are link chain or the like made from lightweight materials such as plastic. Such lightweight plastics provide suitable tensile strength to support the display trays and may be advantageously formed of colored materials, if desired. The suspension strands 12 are formed of interconnected links to permit the strands to flex. Such interconnected links also advantageously provide an aperture in each link which permits convenient attachment of brackets for supporting the trays 13 and panels 30. Suspension strands 12 may be formed in other flexible configurations or may be in the form of cables or ropes provided with loops or other attachments which provide an aperture for mounting brackets to support the display trays.

Figure 3C:
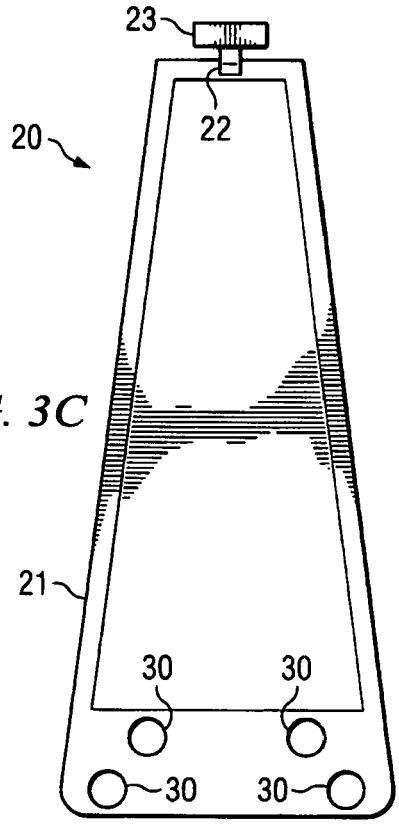
FIG. 3C is an elevational view of an alternative embodiment of a mounting bracket for supporting the tray as illustrated in FIG. 1.
Figure 3A:
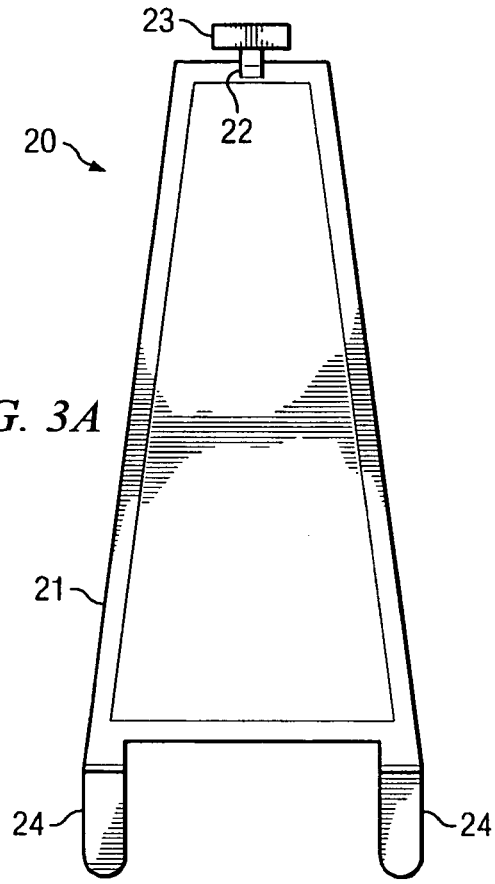
FIG. 3A is an elevational view of a preferred embodiment of the mounting bracket for supporting the tray as illustrated in FIG. 1.
Figure 3B:
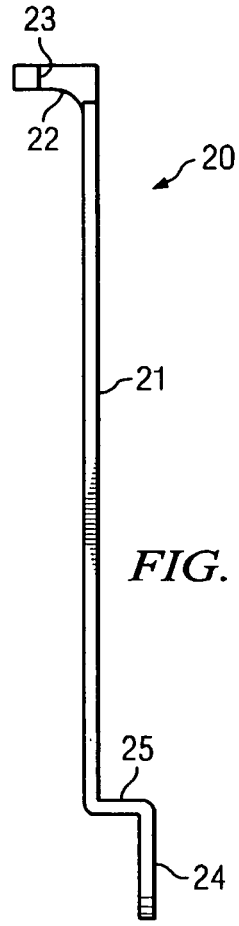
FIG. 3B is an edge view of the bracket of FIG. 3A.

The preferred embodiment of bracket 20 is illustrated in FIGS. 3A and 3B. Each bracket comprises a body 21 having an upper end and a lower end. The upper end terminates in a post or tab 22 adapted to extend through an aperture in the suspension strand 12. In the preferred embodiment, the tab 22 terminates in an expanded boss 23. The tab 22 and boss 23 are sized and shaped to permit the boss 23 to be inserted through an aperture in suspension strand 12 but prevent unintended removal of the tab 22 from the aperture. The bracket 20 is thus suspended adjacent the suspension strand 12 and secured to strand 12 by tab 22 extending through an aperture in strand 12. Boss 23, on the opposite side of strand 12, prevents unintended disconnection of bracket 20 from strand 12.

The lower end of bracket 20 supports means for securing the bracket 20 to a side wall 16 of tray 13. In the embodiment illustrated in FIGS. 3A and 3B the means for securing the bracket 20 to a side wall 16 comprises a pair of pins 24, each having a shoulder 25, adapted to project through an aperture in the side wall 16 of tray 13.

Figure 2:
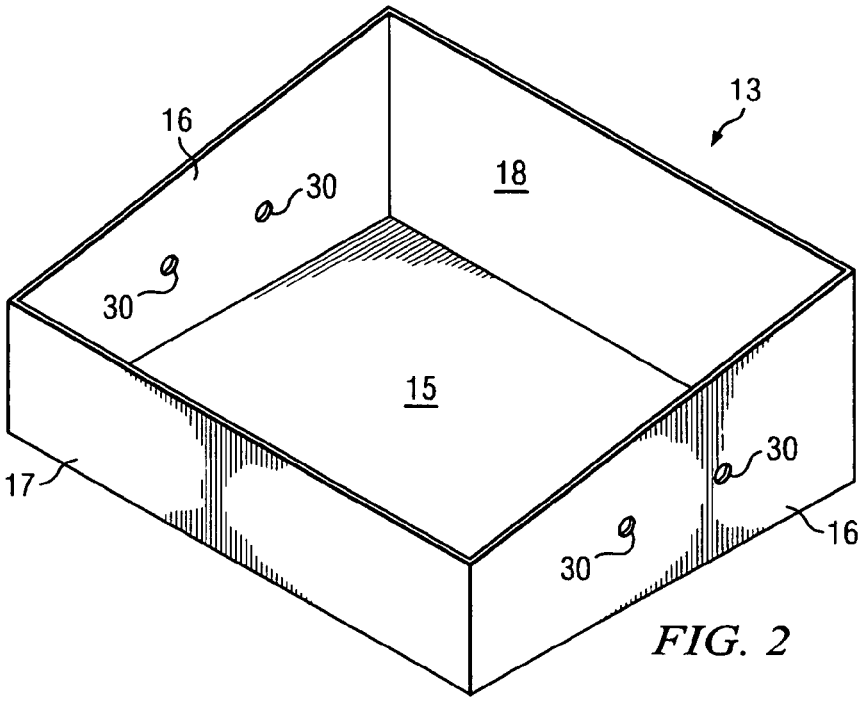
FIG. 2 is a perspective view of one embodiment of a shelf or tray for use in the apparatus of FIG. 1.

As illustrated in FIG. 2 the side wall 16 of tray 13 is provided with a pair of spaced-apart apertures 30. The apertures 30 are positioned to mate with pins 24 projecting from the lower end of bracket 20 so that when pins 24 are inserted into apertures 30 and bracket 20 aligned alongside side wall 16 as illustrated in FIG. 1, side wall 16 is supported on shoulders 25, thus supporting the tray 13 between suspension strands 12. Pins 24 may also be formed in other shapes or configurations, such as hooks, headed pins and the like which mate with apertures, slots or the like to form secure interconnection with the apertures in side wall 16.

It will be observed that when the pins 24 are positioned parallel with the bottom horizontal edge of bracket 20 and apertures 30 are disposed along a line parallel with the surface of floor 15, the tray 13 will be supported with its floor 15 positioned substantially level in a substantially horizontal plane. In many cases, however, it is desirable that the floor 15 be tilted with respect to horizontal, thus permitting merchandise displayed on floor 15 to move by gravity toward the back wall 18 (if floor 15 is lower at back wall 18) or toward front wall 17 (if floor 15 is lower at the front wall 17).

If the floor 15 of tray 13 is to be tilted toward the back wall 18, the apertures should be disposed along a line which diverges upwardly from the plane of floor 15. The apertures in side wall 15 (shown as apertures 30, 31 in FIG. 2A) thus permit the tray 13 to be supported by bracket 20 with the rear edge of floor 15 lower than the front edge. With the apertures aligned parallel with the floor 15 (shown as apertures 30, 30 in FIGS. 2 and 2B) the floor 15 is supported substantially level in a horizontal plane. With the apertures aligned along a line which diverges away from floor 15 toward the front wall 17 (shown as apertures 30, 32 in FIGS. 2C and 2D) the floor 15 is tilted forward.

Figure 2A:
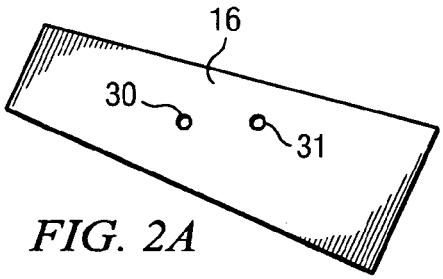
FIG. 2A is a side view of one embodiment of the tray of FIG. 2 showing placement of the support means for mounting the tray in a rearward-tilting arrangement.
Figure 2B:
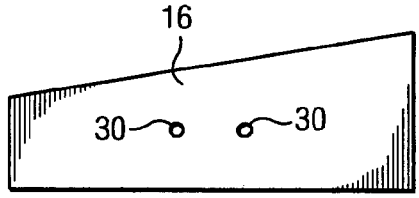
FIG. 2B is a side view of one embodiment of the tray of FIG. 2 showing placement of the support means for mounting the tray in a substantially level arrangement.
Figure 2C:
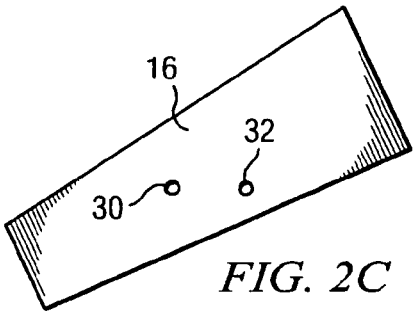
FIG. 2C is a side view of one embodiment of the tray of FIG. 2 showing placement of the support means for mounting the tray in a forward-tilting arrangement.
Figure 2D:
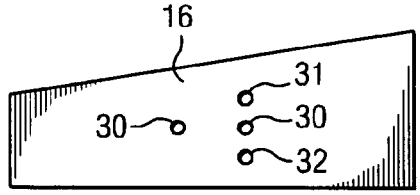
FIG. 2D is a side view of one embodiment of the tray of FIG. 2 showing placement of adjustable support means for mounting the tray with its floor in any of various arrangements.

In the arrangements shown in FIGS. 2A, 2B and 2C, the floor of the tray 13 is disposed either tilted toward back wall 18, level or tilted toward front wall 17. The tray 13 may be made adjustably mountable in any of a plurality of positions by including apertures alignable with pins 24 in any of a multiple positions. As shown in FIG. 2D, the tray floor 15 may be tilted rearward by mounting pins 24 in apertures 30, 31; may be aligned substantially level by mounting pins 24 in apertures 30, 30; or may be tilted forward by mounting pins 24 in apertures 30, 32.

Figure 2E:
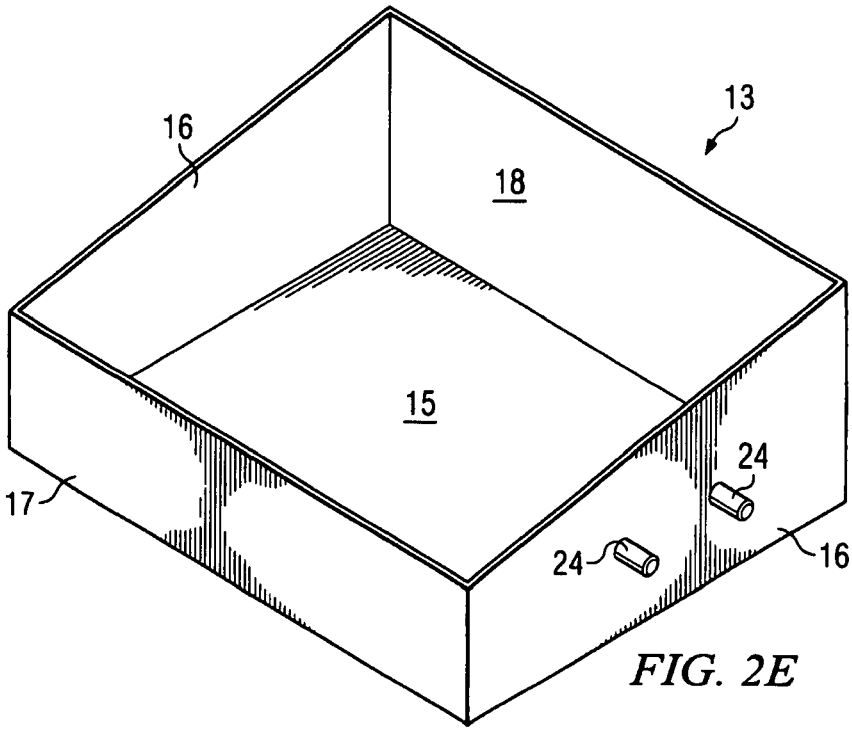
FIG. 2E is a perspective view of an alternative embodiment of a shelf or tray for use in the apparatus of FIG. 1.

It will be appreciated that the pin and aperture means for securing the bracket 20 to side wall 16 as illustrated and discussed above is uniquely simple and reliable and may be easily assembled, used and changed without use of tools. The parts may be readily and inexpensively manufactured using standard manufacturing techniques and readily available materials. It should be recognized, however, that equally acceptable results may be obtained with slightly modified structures. For example, the pin and aperture arrangement may be reversed, i.e, mounting the pins 24 on the side walls 16 and providing apertures 30 in the bracket 20 as illustrated in FIGS. 2E and 3C. Other similar attachment means such as tongue and groove arrangements, shaped pin in slot arrangements, hook and eye arrangements, and mechanically equivalent linkage or attachment means may be used without departing form the principles of the invention. Accordingly, the terms "pin" and "aperture," as used in connection with securing the bracket 20 to a side wall 16, are used herein and intended to cover and include all such similar and equivalent attachment devices.

It will be appreciated that the parallel suspension strands depending from overhead structure traverse space which is ordinarily and otherwise unoccupied. In accordance with the invention, the suspension strands may be used to support advertising graphics or the like in such previously unoccupied and unused space.

Figure 4:
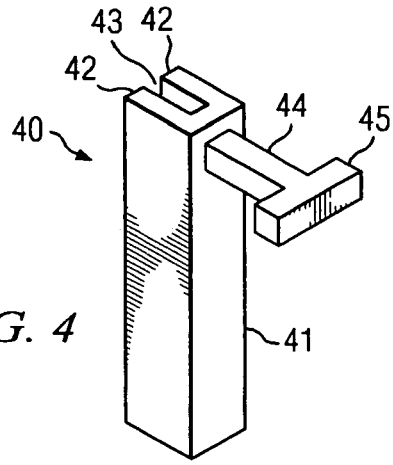
FIG. 4 is a perspective view of the preferred embodiment of a bracket for supporting the graphic display panel in the apparatus illustrated in FIG. 1.

As illustrated in FIG. 1 advertising material or other display apparatus may be supported on the suspension strands 12. In the preferred embodiment advertising graphics are displayed on a panel 30 comprising a substantially flat body having first and second oppositely disposed faces supported by a pair of support brackets 40 (illustrated in FIG. 4).

In the embodiment illustrated, support bracket 40 comprises an elongated body having a first side 41 and an oppositely disposed second side 42. A groove 43 formed in the second side is adapted to mate with opposite sides of edges of panel 30 and firmly grasp panel 30 therein. A post 44 extending from the second side 42 terminates in an expanded boss or head 45. The post 44 and boss 45 are adapted to be inserted through and supported in an aperture in suspension strand 12. The expanded boss 45 is preferably adapted to pass through an aperture in the suspension strand 12 but prevent unintended removal of the post 44 therefrom.

With support brackets 40 on opposite edges of panel 30, the panel 30 may be mounted between the parallel suspension strands 12 and pivot about the posts 45, thus providing a display which is reactive to motion and/or airflow. With support brackets 40 attached near the upper portion of panel 30, the panel 30 is free to swing between the suspension strands and thus provide an active attention-attracting display.

The information displayed on panel 30 may be passive graphics or active displays such as illuminated displays. Air-activating, electrically-activated and/or motion-activated devices may also be supported in the panel 30, as desired. By mounting the panel 30 using brackets 40 as described, the panels 30 may be readily removed, re-arranged or replaced as required.

All components of any of the various designs of apparatus for practicing the invention may be fabricated and assembled using readily available materials and manufacturing techniques. Furthermore, many suitable structures are readily and inexpensively available for use as the suspension strands of the invention, and all components may be readily manufactured using any of a wide variety of suitable materials.

While only exemplary embodiments of the invention have been illustrated and described in detail herein, it will be readily recognized that the principles of the invention may be used in various forms using a wide variety of components assembled in accordance with the teachings of this invention to achieve the benefits and advantages thereof. It is to be understood, therefore, that even though numerous characteristics and advantages of the invention have been set forth in the foregoing description together with details of the structure and function of the various embodiments, this disclosure is to be considered illustrative only. Various changes and modifications may be made in detail, especially in matters of shape, size, and materials as well as arrangement and combination of parts, without departing from the spirit and scope of the invention as defined by the appended claims.

What is claimed is:

1. Apparatus for supporting and displaying merchandise comprising:

a) suspension means adapted for attachment to overhead structure and having first and second laterally spaced-apart ends adapted for supporting depending spaced-apart suspension strands;

b) a suspension strand depending from each end of said suspension means, each such strand comprising a plurality of interconnected links with at least one of said links in each such strand having an aperture therein;

c) a tray suspended between said suspension strands, said tray having a floor and oppositely disposed side walls; and d) a suspension bracket attaching each of said side walls to one of said suspension strands, each said bracket having an upper end and a lower end with a tab extending from said upper end and through an aperture in one of said suspension strands and said lower end having means for securing said bracket to a side wall of said tray.

2. Apparatus as defined in claim 1 wherein each of said suspension strands comprises a chain of elongated interconnected links.

3. Apparatus as defined in claim 1 wherein said tray includes a front wall having a first height and a back wall having a second height.

4. Apparatus as defined in claim 1 wherein said means for securing said bracket to a side wall of said tray comprises horizontally spaced-apart pins extending from the lower end of the bracket mating with spaced-apart apertures in the sidewall of the tray.

5. Apparatus as defined in claim 4 wherein the apertures in the side wall of said tray are arranged to mate with the pins extending from said bracket to support the floor of said tray substantially horizontal.

6. Apparatus as defined in claim 4 wherein the apertures in the side wall of said tray are arranged to mate with the pins extending from said bracket to support the floor of said tray at an angle which deviates from horizontal.

7. Apparatus as defined in claim 1 wherein said means for securing said bracket to a side wall of said tray comprises horizontally spaced-apart pins extending from the side wall of the tray mating with spaced-apart apertures in the bracket.

8. Apparatus as defined in claim 7 wherein the apertures in the bracket are arranged to mate with the pins extending from the side wall of said tray to support the floor of said tray substantially horizontal.

9. Apparatus as defined in claim 7 wherein the apertures in the bracket are arranged to mate with the pins extending from the side wall of said tray to support the floor of said tray at an angle which deviates from horizontal.

10. Apparatus as defined in claim 1 further comprising:

(e) a graphic display supported between said spaced apart suspension strands and above said tray.

11. Apparatus as defined in claim 10 wherein said graphic display is supported on a substantial flat panel having oppositely disposed first and second faces.

12. Apparatus as defined in claim 11 further comprising:

(f) support brackets for suspending said flat panel, each support bracket comprising:

(i) an elongated body having first and second oppositely disposed side faces;

(ii) a groove in said first side face adapted to mate with and grasp an edge of said panel; and (iii) a pin extending from said second side face and extending through an aperture in one of said suspension strands.

13. Apparatus for supporting and displaying merchandise comprising:

a) suspension means adapted for attachment to overhead structure and supporting a pair of depending spaced-apart suspension strands;

b) a pair of spaced-apart suspension strands depending from said suspension means, each such strand comprising a plurality of interconnected links with at least one of said links in each such strand having an aperture therein;

c) a tray suspended between said spaced-apart suspension strands, said tray having a floor and oppositely disposed side walls; and d) a suspension bracket attaching each of said side walls to one of said suspension strands, each said bracket having an upper end and a lower end with a tab extending from said upper end and through an aperture in one of said suspension strands and said lower end having means for securing said bracket to a side wall of said tray comprising horizontally spaced-apart pins extending from the side wall of the tray mating with spaced-apart apertures in the bracket.

14. Apparatus as defined in claim 13 wherein the apertures in the bracket are arranged to mate with the pins extending from the side wall of said tray to support the floor of said tray substantially horizontal.

15. Apparatus as defined in claim 13 wherein the apertures in the bracket are arranged to mate with the pins extending from the side wall of said tray to support the floor of said tray at an angle which deviates from horizontal.

* * * * *